US007583135B2

(12) United States Patent
Ashburn, Jr. et al.

(10) Patent No.: US 7,583,135 B2
(45) Date of Patent: Sep. 1, 2009

(54) AUTO-NULLED BANDGAP REFERENCE SYSTEM AND STROBED BANDGAP REFERENCE CIRCUIT

(75) Inventors: Michael A. Ashburn, Jr., Groton, MA (US); Stephen W. Harston, Andover, MA (US)

(73) Assignee: Analog Devices, Inc., Norwood, MA (US)

( * ) Notice: Subject to any disclaimer, the term of this patent is extended or adjusted under 35 U.S.C. 154(b) by 67 days.

(21) Appl. No.: 11/903,113

(22) Filed: Sep. 20, 2007

(65) Prior Publication Data

US 2008/0079413 A1 Apr. 3, 2008

Related U.S. Application Data

(60) Provisional application No. 60/848,919, filed on Oct. 3, 2006.

(51) Int. Cl.
*G05F 1/10* (2006.01)
*G05F 3/02* (2006.01)

(52) U.S. Cl. ..... 327/539; 327/313

(58) Field of Classification Search ..... 327/539, 327/313, 315–316

See application file for complete search history.

(56) References Cited

U.S. PATENT DOCUMENTS 6,531,911 B1 * 3/2003 Hsu et al. ..... 327/512

OTHER PUBLICATIONS

Sanduleanu, M.A.T., et al., Accurate Lower Power Bandgap Voltage Reference in 0.5 μm CMOS Technology, Electronics Letters, May 14, 1998, vol. 34, No. 10, pp. 1025-1026.

* cited by examiner

*Primary Examiner*—Lincoln Donovan
*Assistant Examiner*—Daniel Rojas
(74) *Attorney, Agent, or Firm*—Kenyon & Kenyon LLP

(57) ABSTRACT

An auto-nulled bandgap reference system employing a substrate bandgap reference circuit with primary and auxiliary amplifiers and a switching circuit which in a first mode develops a voltage to null the offset and noise errors of the auxiliary amplifier and then in the second mode uses the nulled auxiliary amplifier to develop a voltage to null the offset and noise errors of the primary amplifier; and a strobe circuit including an output storage device and a strobe control circuit for periodically powering up a bandgap reference circuit to charge the output storage device and powering down the bandgap reference circuit to conserve power.

36 Claims, 7 Drawing Sheets

Standard Substrate Bandgap Reference w/Auto-Nulled Amplifier

AUTO-NULLED BANDGAP REFERENCE SYSTEM AND STROBED BANDGAP REFERENCE CIRCUIT

RELATED APPLICATIONS

This application claims benefit of and priority to U.S. Provisional Application Ser. No. 60/848,919 filed Oct. 3, 2006 incorporated herein by this reference.

FIELD OF THE INVENTION

This invention relates to an auto-nulled bandgap reference system and also to a strobed bandgap reference circuit adapted for use with an auto-nulled or other bandgap reference.

BACKGROUND OF THE INVENTION

As the semiconductor industry continues to mature, cost pressures persist that drive companies to continually reduce manufacturing costs. A direct result of this pricing pressure is the movement to smaller geometry fabrication processes with reduced feature sets. A consequence of the reduced process feature set is the removal of dedicated (non-substrate) bipolar devices that would require extra processing steps, and therefore cost, to implement. Note bipolar devices typically exhibit substantially smaller (and more predictable over temperature) offset voltages and have less noise when compared with MOS (metal-oxide-semiconductor) devices. However since dedicated bipolar devices are not available in most reduced feature set processes of today, MOS devices must typically be used. The larger and less predictable device mismatch levels in MOS devices result in larger and less predictable circuit performances both for initial tolerances and drift over temperature. Additionally, increasing relative noise levels in circuits using MOS devices are exacerbated by reductions in process line width due to thinner gate oxides. The increased noise levels and larger voltage shifts over temperature resulting from MOS devices are un-desirable features in a voltage reference.

A standard substrate bandgap reference current uses a pair of diode connected substrate bipolar junction transistors with different current densities to develop a proportional-to absolute-temperature (PTAT) voltage ($\Delta V_{BE}$) across associated resistors. Though there are several other contributors to the temperature variation in the reference e.g. transistor temperature coefficients, differential temperature coefficients in the resistors, $V_{BE}$ curvature, and accuracy of the bandgap voltage, the dominant factor, and the one addressed by this invention, is the offset and drift of the amplifier when an MOS amplifier is used. Like all bipolar devices, the buried junctions of the substrate bipolar junction transistors have a relatively small response to package stress and typically match closely during fabrication. Layout techniques enhance this behavior and initial matching errors can be trimmed by adjusting the output voltage of the reference. The resistor-to-resistor temperature coefficient variation benefits from all the same layout techniques that improve resistor matching and can typically be reduced to the point where it is not an issue. Vbe curvature, a nonlinearity in the transistors that results in an undesired shift in the reference voltage over temperature, can be reduced to acceptable levels using one of many known correction techniques. The bandgap voltage is usually very stable on a given process and is not typically the limitation for a reference design. This leaves the non-idealities of the MOS amplifier, input referred offset, temperature drift, and noise, as the dominant error sources in the reference. The input referred offset and noise voltage of the MOS amplifier are gained up by an approximate factor of $(1+R_2/R_3)$ to the output of the reference. Though this gain can be minimized by increasing the PTAT voltage, practical limitations on the ratio of current densities in the substrate bipolar junction transistors place the gain factor (on a single bandgap) in the 8×-12× range. Note, this means that a luV/° C. drift in the amplifier results in almost a 10 ppm/° C. drift in the reference. Thus, random drift offsets, and low frequency noise of the MOS amplifier are the main impediment for achieving a tight temperature coefficient specification for the reference.

BRIEF SUMMARY OF THE INVENTION

It is therefore an object of this invention to provide an improved auto-nulled bandgap reference system.

It is a further object of this invention to provide such an improved auto-nulled bandgap reference system which removes or at least reduces both the offset and low frequency noise effects of the amplifier.

It is a further object of this invention to provide such an improved auto-nulled bandgap reference system which reduces the voltage shift of the reference over temperature.

It is a further object of this invention to provide such an improved auto-nulled bandgap reference system which relocates or spreads the noise within the pass band of the intended application.

It is a further object of this invention to provide such an improved auto-nulled bandgap reference system which can apply the auto-nulling effect at a constant frequency, by frequency hopping or by random or spread spectrum frequency techniques.

It is also an object of this invention to provide an improved strobed bandgap reference circuit for use with an auto-nulled or other bandgap reference.

It is a further object of this invention to provide such an improved strobed bandgap reference circuit which powers up periodically to refresh the voltage reference and between refreshes, powers down the reference to save current.

It is a further object of this invention to provide such an improved strobed bandgap reference circuit which can reduce the average supply current by a factor or 1000 or more.

The invention results from the realization that a truly effective removal or reduction of amplifier offset and noise errors can be achieved with an auto-nulled bandgap reference system employing a substrate PTAT bandgap reference circuit with primary and auxiliary amplifiers and a switching circuit which in a first mode develops a voltage to null the offset and noise errors of the auxiliary amplifier and then in the second mode uses the nulled auxiliary amplifier to develop a voltage to null the offset and noise errors of the primary amplifier to maintain its output PTAT.

The invention further realizes that a significant reduction in average power required to operate auto-nulled and other bandgap references can be accomplished with a strobe circuit including an output storage device and a strobe control circuit for periodically powering up a bandgap reference circuit to charge the output storage device and powering down the bandgap reference circuit to conserve power.

The subject invention, however, in other embodiments, need not achieve all these objectives and the claims hereof should not be limited to structures or methods capable of achieving these objectives.

This invention features an auto-nulled bandgap reference system including a substrate bandgap core having a differential output, a primary amplifier for receiving at its input the differential output of the bandgap core, and a feedback circuit responsive to the primary amplifier to drive to zero the differential signal at its input. The primary amplifier has inherent offset and noise errors. A first storage device is connected to a nulling input of the primary amplifier. There is an auxiliary amplifier having inherent offset and noise errors and there is a second storage device connected to a nulling input of the auxiliary amplifier. A switching circuit selectively, in a first mode, shorts the inputs of the auxiliary amplifier and connects its output to the second storage device to develop a compensation voltage for nulling the noise and offset error of the auxiliary amplifier and in a second mode connects the input of the nulled auxiliary amplifier in parallel with the input to the primary amplifier and connects the output of the nulled auxiliary amplifier to the first storage device to develop a compensation voltage for nulling the noise and offset error of the primary amplifier.

In a preferred embodiment the nulling inputs may be differential inputs. The nulling inputs may further include a nulling control circuit for providing a switching signal to drive the switching circuit between the first and second modes. The switching signal may be a constant frequency. The switching signal may be "hopping" between different frequencies. The switching signal may be spread spectrum. The substrate bandgap core may include a pair of pn junctions. The substrate bandgap core may include multiple pairs of stacked pn junctions. The pn junctions may be implemented with diode connected bipolar junction transistors. It may further including a strobe circuit including an output storage device interconnected with the output of the primary amplifier, and a strobe control circuit for periodically powering up the auto-nulled bandgap reference system to charge the output storage device and powering down the auto-nulled bandgap reference system to conserve power. The output storage device may be interconnected through a switch to the output of the primary amplifier. It may further include a start up circuit responsive to a predetermined condition at the output storage device for enabling the strobe control circuit. The predetermined condition may be a voltage level. The start up circuit may include a comparator circuit. It may further include a temperature sensor circuit for varying the rate of periodicity of the strobe control circuit as a function of temperature. The amplifiers may be MOS devices. The output storage device may include a capacitor.

This invention also features a strobed bandgap reference circuit including a bandgap reference circuit and a strobe circuit including an output storage device interconnected with the output of the bandgap reference circuit. A strobe control circuit periodically powers up the bandgap reference circuit to charge the output storage device and powers down the bandgap reference circuit to conserve power.

In a preferred embodiment the output comparator may be interconnected through a switch to the output of the primary amplifier. The bandgap reference circuit may include a substrate bandgap reference circuit. The strobed bandgap reference circuit may further include a substrate bandgap core having a differential output, a primary amplifier for receiving at its input the differential output and a feedback circuit responsive to the primary amplifier to drive to zero the differential output at its input. The primary amplifier may have inherent offset and noise errors. A first storage device may be connected to a nulling input of the primary amplifier. There may be an auxiliary amplifier having inherent offset and noise errors. A second storage device may be connected to a nulling input of the auxiliary amplifier. A switching circuit may selectively, in a first mode, short the inputs of the auxiliary amplifier and connect its output to the second storage device to develop a compensation voltage for nulling the noise and offset error of the auxiliary amplifier and in a second mode connect the input of the nulled auxiliary amplifier in parallel with the input to the primary amplifier and connect the output of the nulled auxiliary amplifier to the first storage device to develop a compensation voltage for nulling the noise and offset error of the primary amplifier.

In a preferred embodiment the nulling inputs may be differential inputs. There may be a nulling control circuit for providing a switching signal to drive the switching circuit between the first and second modes. The switching signal may be a constant frequency. The switching signal may be frequency hopping. The switching signal may be spread spectrum. The substrate bandgap core may include a pair of pn junctions. The substrate bandgap core may include multiple pairs of stacked pn junctions. The pn junctions may be implemented with diode connected bipolar junction transistors. An output comparator may be interconnected through a switch to the output of the primary amplifier. There may be a start up circuit responsive to a predetermined condition at the output storage device for enabling the strobe control circuit. The predetermined condition may be a voltage level. The start up circuit may include a comparator circuit. There may be a temperature sensor circuit for varying the rate of periodicity of the strobe control circuit as a function of temperature. The amplifiers may be constructed from MOS devices. The output storage device may include a capacitor.

This invention also features an auto-nulled bandgap reference system including a substrate bandgap reference circuit including a primary amplifier having inherent offset and noise error. There is an auxiliary amplifier circuit having inherent offset and noise error. A switching circuit, in a first mode, develops a voltage to null the offset and noise errors of the auxiliary amplifier and in a second mode connects together in parallel the inputs of the primary and auxiliary amplifiers for developing with the nulled auxiliary amplifier a voltage to null the offset and noise errors of the primary amplifier. In a preferred embodiment the substrate bandgap reference circuit may include a substrate bandgap core having a differential output. The primary amplifier may receive at its output the differential output. A feedback circuit responsive to the primary amplifier output to drive to zero the differential output at its input. There may be a first storage device connected to a nulling input of the primary amplifier, and a second storage device connected to a nulling input of the auxiliary amplifier. The switching circuit in a first mode may short the input of the auxiliary amplifier and connects its output to the storage device to develop a compensation voltage for nulling the noise and offset error of the auxiliary amplifier and in a second mode may connect the input of the nulled auxiliary amplifier in parallel with the input of the primary amplifier and connecting the output of the nulled auxiliary amplifier to the first storage device to develop a compensation voltage for nulling to noise and offset error of the primary amplifier. The nulling inputs may be differential inputs. There may be a nulling control circuit for providing a switching signal to drive the switching circuit between the first and second modes. The switching signal may be a constant frequency. The switching signal may be frequency hopping. The switching signal may be spread spectrum. The substrate bandgap core may include a pair of pn junctions. The substrate bandgap core may include multiple pairs of stacked pn junctions. The pn junctions may be implemented with diode connected bipolar junction transistors. There may be a strobe circuit including an output storage device interconnected with the output of the primary amplifier, and a strobe control circuit for periodically powering up the auto-nulled bandgap reference system to charge the output storage device and powering down the auto-nulled bandgap reference system to conserve power. The output storage device may be interconnected through a switch to the output of the primary amplifier. There may be a start up circuit responsive to a predetermined condition at the output storage device for enabling the strobe control circuit. The predetermined condition may be a voltage level. The start up circuit may include a comparator circuit. There may be a temperature sensor circuit for varying the rate of periodicity of the strobe control circuit as a function of temperature. The amplifiers may be constructed from MOS devices.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
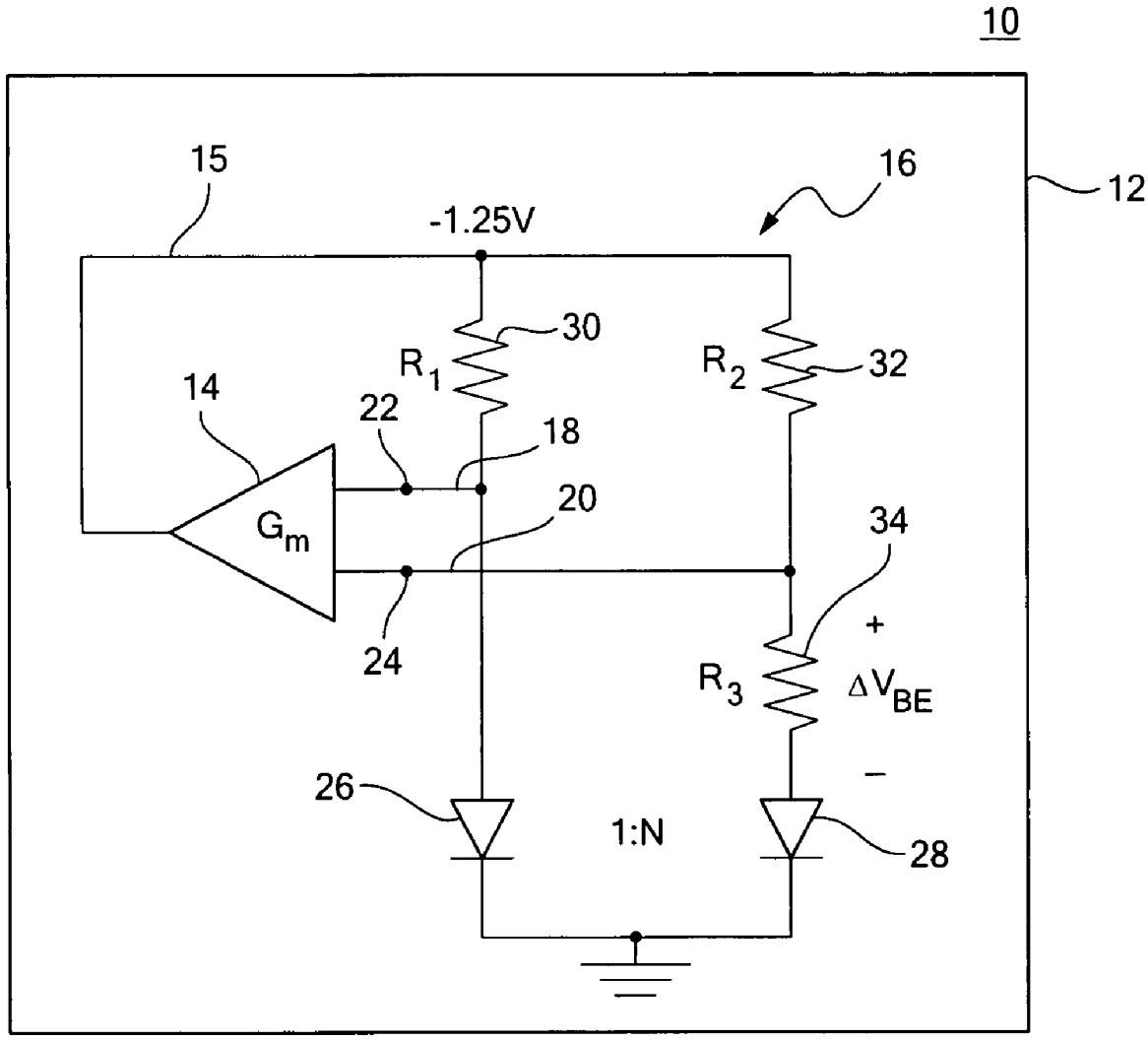
FIG. 1 (PRIOR ART)
FIG. 1 is a schematic diagram of a prior art substrate bandgap reference circuit.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

There is shown in FIG. 1 a basic substrate bandgap reference circuit 10 contained on the single MOS chip 12 including an amplifier 14 and a substrate PTAT bandgap core 16 which has a differential output 18, 20 to the differential input 22, 24 of amplifier 14. Amplifier 14 operates with a feedback circuit 15 which responds to the output of amplifier 14 to drive to zero the differential output 18, 20 at inputs 22 and 24. The inherent offset and noise errors associated with such amplifiers is a problem. Bandgap core 16 includes a pair of bandgap reference diodes 26 and 28 which may be diodes but are typically diode connected substrate bipolar junction transistors. Bandgap core 16 also includes three resistors $R_1$ 30, $R_2$ 32, and $R_3$ 34. In this circuit a differential base emitter voltage ($\Delta V_{BE}$) is developed by running different current densities into two bipolar devices 26 and 28. The same $\Delta V_{BE}$ can be achieved by using differently sized bipolar devices or a combination of these effects. The resulting differential voltage is used to develop a proportional to absolute temperature (PTAT) current that in turn is used to generate larger PTAT voltages. The circuit is configured so that the base emitter voltage with the substrate bipolar known to be complementary to absolute temperature (CTAT) is added to the generated PTAT voltage so that the resulting reference output voltage shows little variation over temperature. This is standard architecture and well known to those skilled in the art. In MOS process the largest contribution offset and low frequency noise in such a reference circuit results from the MOS devices used in the amplifier that provide the large loop gain necessary in this circuit. In accordance with this invention those noise sources are removed or reduced.

Figure 2A:
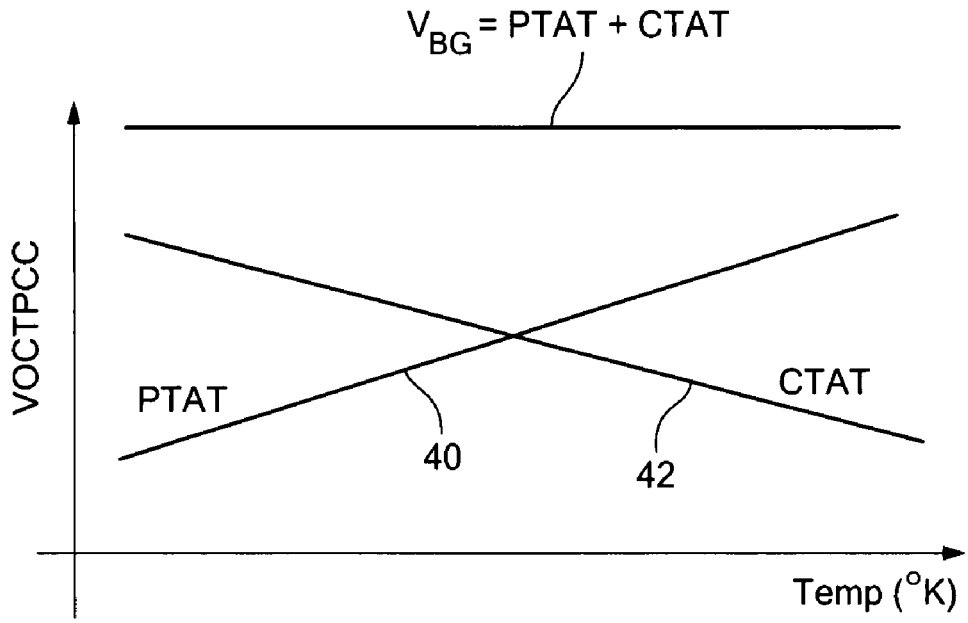
FIG. 2A illustrates PTAT, CTAT, (complementary to absolute temperature) and PTAT plus CTAT ($V_{BG}$) characteristics of the circuit of FIG. 1.
Figure 2B:
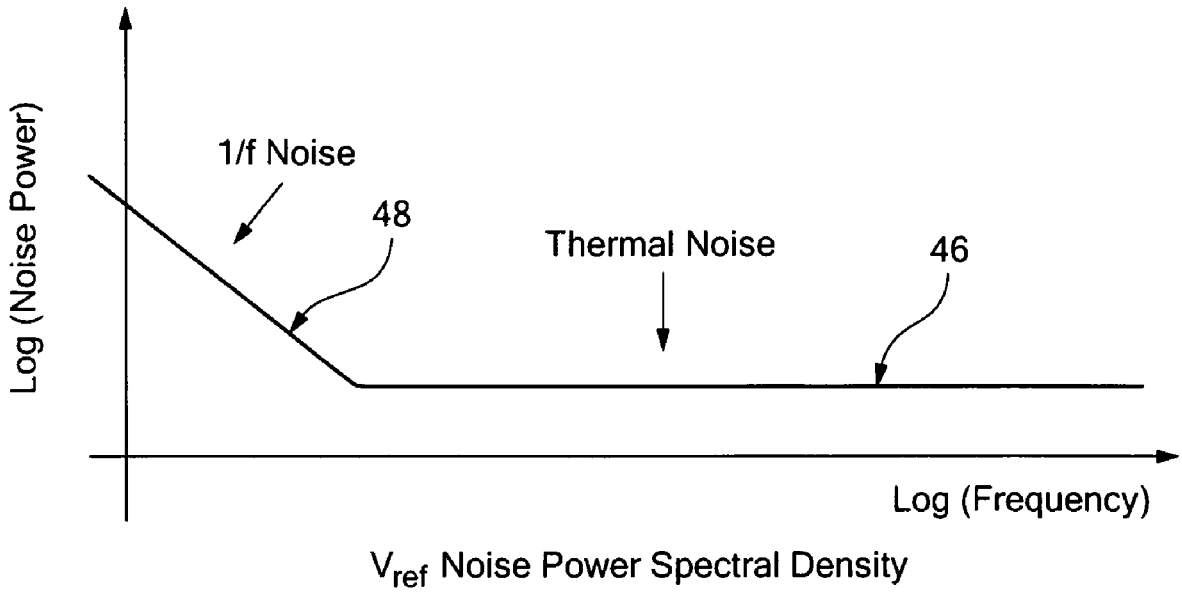
FIG. 2B illustrates the noise power spectral density.

The characteristic PTAT 40 and CTAT 42 voltages, FIG. 2A, combine to form a virtually temperature insensitive voltage $V_{BG}$. The nulling technique of this invention which removes offset in the amplifier has the same effect on low frequency noise as it has on offset voltages in that it removes or greatly reduces the noise that occurs at frequencies well below the frequency at which the auxiliary amplifier is switched in and out of the main loop. As low frequency (1/f) noise becomes more and more significant and as process geometries are reduced this becomes more and more important. This is shown in FIG. 2B, where the thermal noise 46 and 1/f noise 48 are shown in a plot of log of noise power versus log of the frequency.

Figure 3:
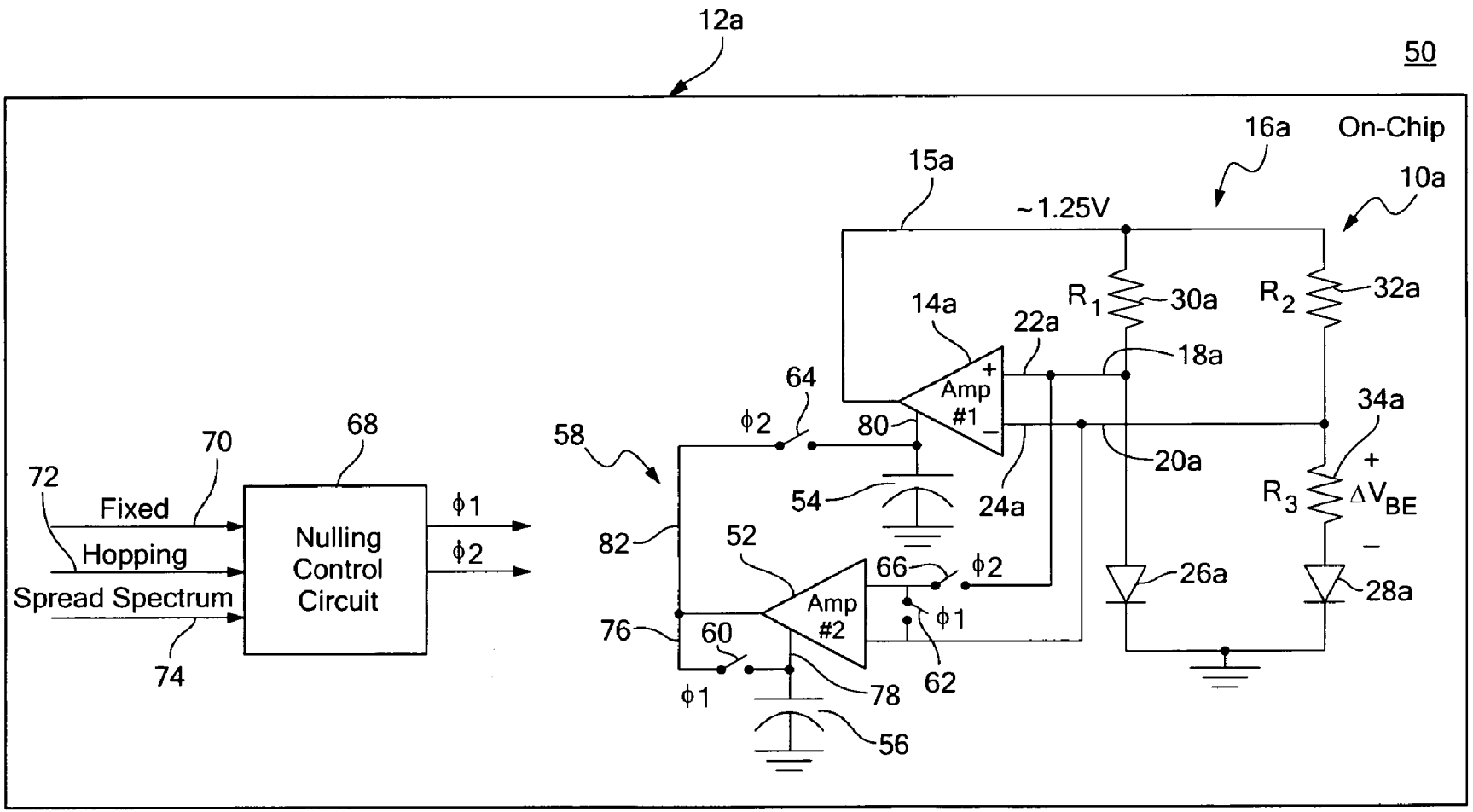
FIG. 3 is a schematic diagram of an auto-nulling substrate bandgap reference system according to this invention.

The auto-nulled bandgap reference system 50 according to this invention is shown in FIG. 3, where similar parts have been given similar numbers accompanied by a lower case letter. Auto-nulled bandgap reference system 50 is located on a single chip 12*a* along with a basic substrate bandgap reference circuit 10*a*, but there is added in this invention a second auxiliary amplifier 52 in addition to the first primary amplifier 14*a*. Also included are storage devices such as capacitors 54 and 56 and a switching circuit 58 which includes switches 60, and 62, which are closed in a first mode $\phi 1$ and two switches 64 and 66 which are closed during a second mode $\phi 2$. The switches are operated on a break before make basis so that at no time will switches 60 and 62 be on at the same time as switches 64 and 66. Switches 60, 62, 64, and 66 are operated by nulling control circuit 68 which provides at its output the $\phi 1$ signal in the first mode, and $\phi 2$ signal in the second mode. Nulling control circuit 68 may be commanded to alternate between the two modes either at a fixed frequency 70 or at a hopping frequency 72 or using a pseudo random or spread spectrum approach 74. The nulling frequency therefore may be moved during operation depending on where noise will cause problems in the application. In some applications it may not be practical or possible to find a safe frequency range for the auto nulling frequency to be set in order to avoid a potential frequency bands of interest. In those cases the auto nulling can be spread spectrum to avoid placing too much unwanted frequency content in a given band.

In operation, in a first mode switches 60 and 62 are closed. Switch 62 shorts together the inputs to auxiliary amplifier 52. With switch 60 also closed a secondary feedback loop 76 is created so that the output of auxiliary amplifier 52 is fed back on the nulling input 78 of auxiliary amplifier 52 to develop a voltage sufficient to cancel any offset voltage at or imbalance between its inputs. This voltage will be stored on storage device or capacitor 56. Switches 60 and 62 are now open preserving that voltage at least for a finite period of time during which auxiliary amplifier 52 operates as a "perfect" amplifier with the offset and low frequency noise at its input reduced to zero, or nearly so. Then in the second mode switches 64 and 66 which have been opened during the first mode are closed. With the closing of switch 66 the inputs to auxiliary amplifier 52 are connected in parallel with the inputs of primary amplifier 14*a*. And the output of auxiliary 52 is delivered to the nulling input 80 of primary amplifier 14*a*. Auxiliary amplifier 52 now perfectly senses the offset and low frequency noise errors at the input of primary amplifier 14*a* and through feedback loop 82 and closed switch 64 develops a voltage at nulling input 80 which compensates for the offset and low noise error at the input of amplifier 14*a*. Primary amplifier 14*a* now operates as a virtually perfect amplifier as did auxiliary amplifier 52. Initially, the auxiliary amplifier 52 is nulling itself and the main amplifier 14*a* controls the loop with its offset set as a function of its inherent offset plus the effect of the voltage stored at its nulling input. Once this phase is complete, the switch connected to the nulling cap input of the auxiliary amplifier 52 is first opened, followed by the switch shorting its inputs together. Next, the switch connecting the inputs of the auxiliary amplifier 52 to the inputs of the main amplifier 14*a* is shorted followed by connecting the output of the auxiliary amplifier 52 to the nulling input of the main amplifier 14*a*. When this clock phase is completed, the connection from the output of the auxiliary amplifier 52 to the nulling input of the main amplifier 14*a* is first disconnected followed by the connection of the auxiliary amplifier 52 inputs to the inputs of the main amplifier 14*a*. To complete the cycle, the inputs of the auxiliary amplifier 52 are first shorted followed by the connection of the output of the auxiliary amplifier 52 to the auxiliary inputs of the main amplifier 14*a*. And thus, the cycle continues.

Figure 4:
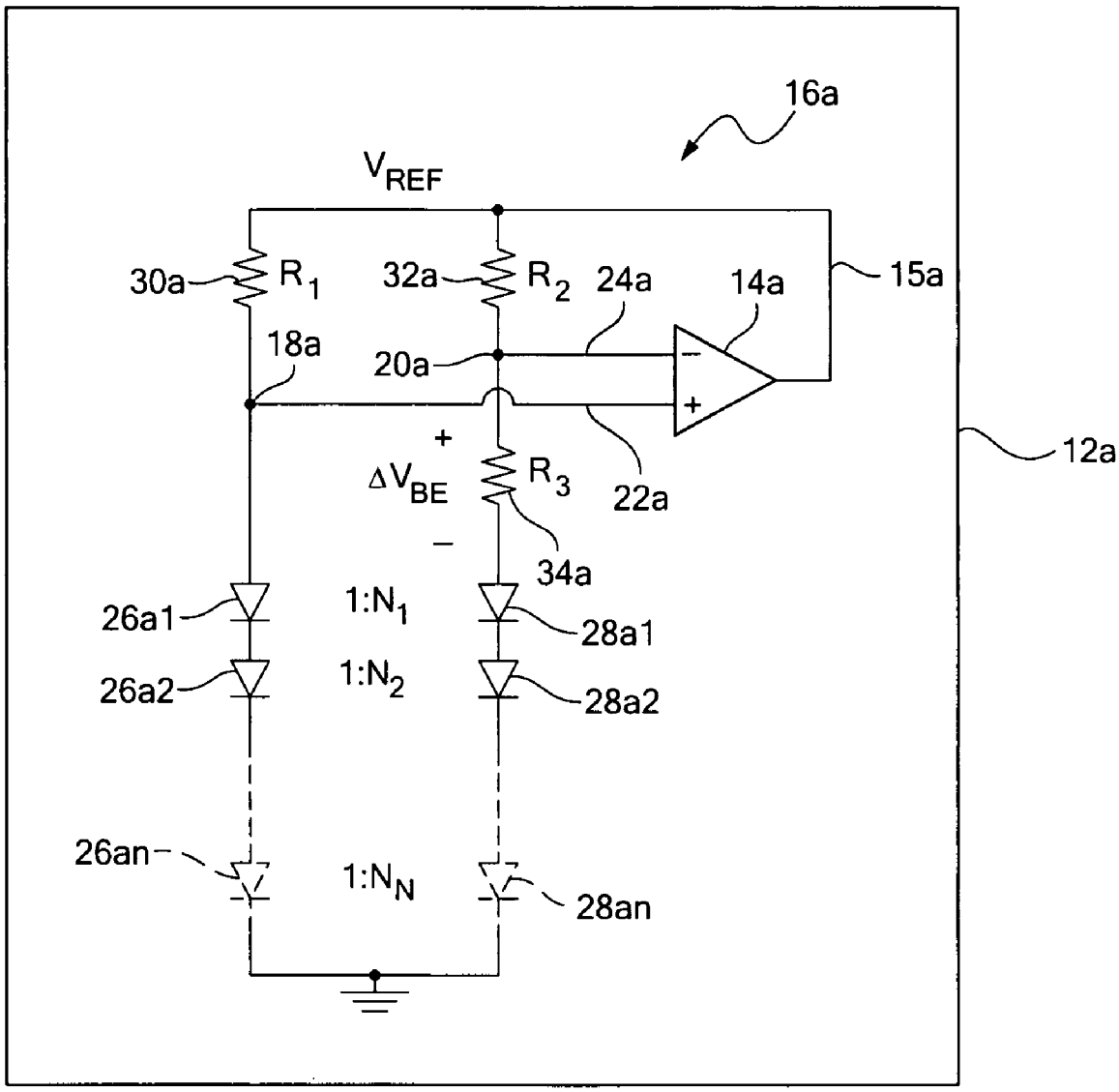
FIG. 4 is a schematic diagram of a portion of the auto-nulling substrate bandgap reference system of FIG. 3 instead using multiple diode connected bipolar junction transistors to implement a multiple (or "stacked") bandgap reference.

While in FIG. 3 the bandgap references are shown as the single pair of diodes or diode connected transistors 26*a* and 28*a*, commonly referred to as a "single bandgap," this is not a necessary limitation of the invention. For example as shown in FIG. 4, each leg may include two or more such diode devices, e.g. 26*a*1, 26*a*2 . . . 26*an*: 28*a*1, 28*a*2 . . . 28*an*, in order to implement a multiple or ("stacked") bandgap reference.

Figure 5:
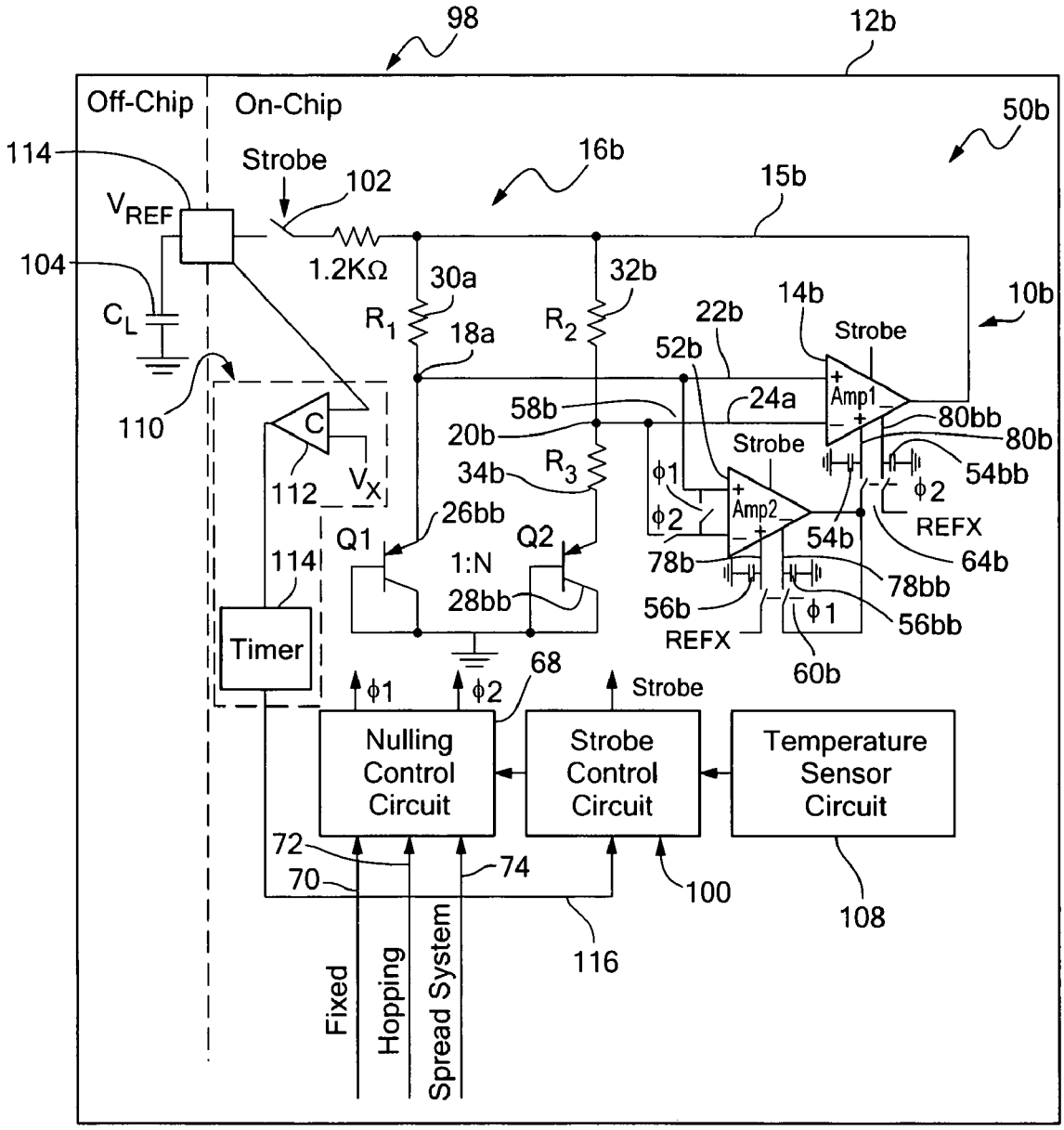
FIG. 5 is a schematic diagram of another embodiment of the auto-nulling substrate bandgap reference system of this invention with the strobe circuit of this invention.

In another embodiment, FIG. 5, primary amplifier 14*b* and auxiliary amplifier 52*b* each have differential nulling inputs 80*b*, 80*bb*, 78*b*, 78*bb*, respectively, so there are two storage devices capacitors 54*b*, 54*bb* and capacitors 56*b* and 56*bb* and the switches are both double pole switches 64*b* and 60*b*.

A strobe circuit 98 according to this invention is also shown in FIG. 5. Strobe circuit 98 includes output storage device 104, refresh switch 102, and strobe control circuit 100. Strobe control circuit 100 provides a periodic strobe signal which closes switch 102 to periodically charge output storage device, capacitor 104, and simultaneously enable the primary 14*b* and auxiliary 52*b* amplifiers which are otherwise disabled in order to conserve power. This is done at a predetermined rate in accordance with the particular application. Since the charge leakage from output storage capacitor 104 is effected by temperature, a temperature sensor circuit 108 may be used to change the rate at which strobe control circuit refreshes storage capacitor 104 in accordance with the temperature sensed. When strobe control circuit 100 powers up amplifiers 14*b* and 52*b*, it also enables nulling control circuit 68 to begin its auto nulling operation. Also shown in FIG. 5 is start up circuit 110 which includes a comparator 112 and a timer 114. Comparator 112 senses the voltage on output terminal 114 and as it rises provides an output signal when it reaches a reference voltage $V_x$. This operates timer 114 so that after a predetermined period of time when the voltage has stabilized a signal is sent on line 116 to enable strobe control circuit 100.

Figure 6:
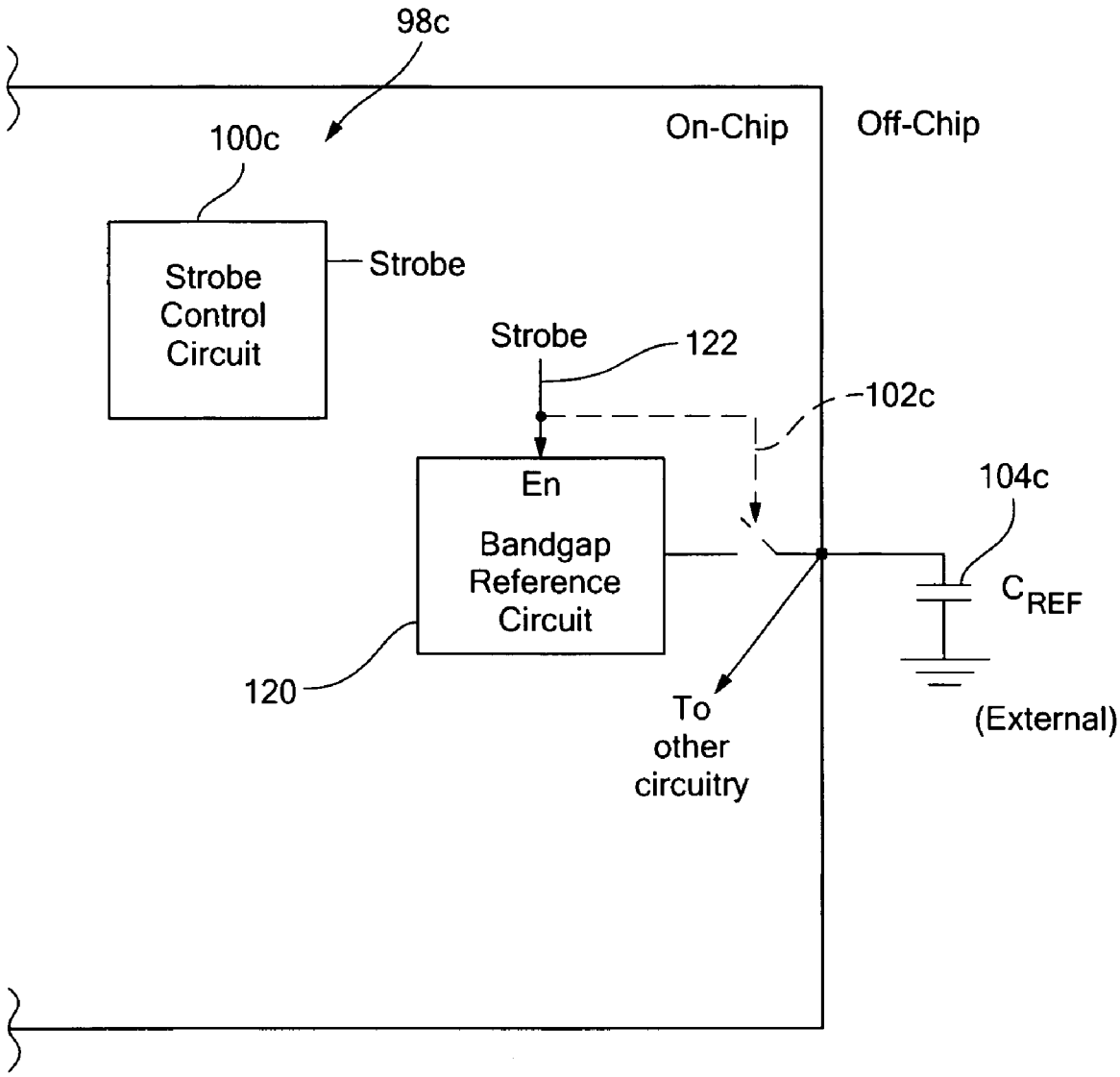
FIG. 6 is a schematic diagram of another embodiment of the strobe circuit of this invention.

Strobe control circuit 98*c* is shown more generally in FIG. 6 as including only strobe control circuit 100*c* and output storage device capacitor 104*c* as switch 102*c* may not always be necessary. The strobe signal on line 122 could simply enable or disable an associated bandgap reference circuit 120 such as auto-nulled bandgap reference system 50, FIG. 3, or 50*b*, FIG. 5, so that it provides output or no output to capacitor 104*c* without the supervision of a switch such as switch 102*c*. If there no switch it may simply have a high impedance output when disabled to allow the output capacitor 104*c* to float.

The average current is substantially reduced by the strobe circuit operation whereby the bandgap reference is powered up periodically to refresh the voltage on the output capacitor and after a short period of refresh the bandgap reference is then completely powered down to save current. When it is powered down and it presents a high impedance output (or if a switch is opened) the output capacitor is then allowed to float and this process repeats cyclically at a predetermined rate.

Figure 7:
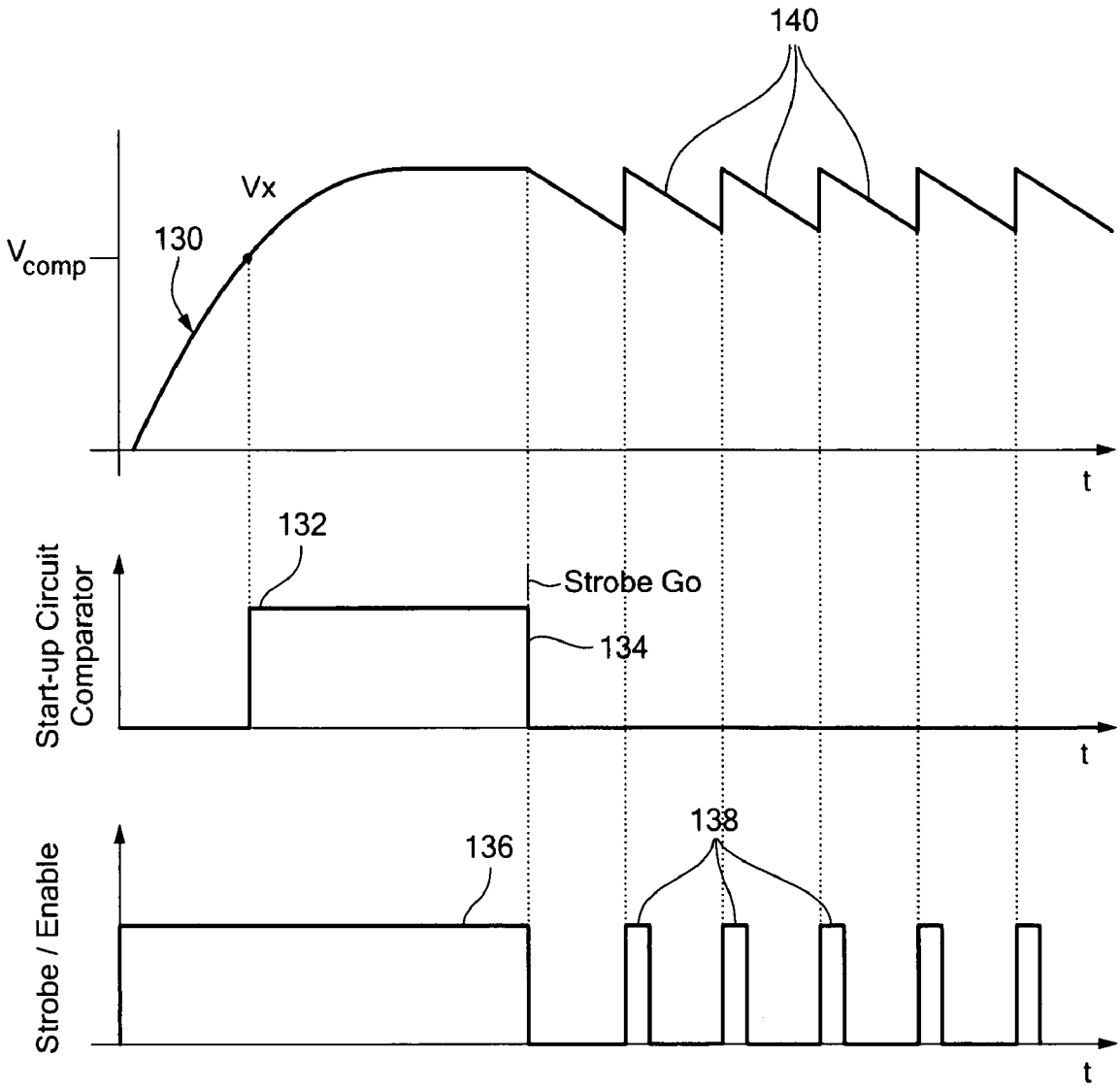
FIG. 7 illustrates the waveforms of the compensation voltage, start up signal and strobe signal generated by the strobe circuit and substrate bandgap reference system of this invention.

In operation, at startup referring to FIGS. 7 and 5 the compensation voltage 130, FIG. 7, rises until it reaches the reference voltage $V_x$ of comparator 112, FIG. 5. This triggers an output from comparator 112 at 132 which operates timer 114 for a period of time until it reaches time 134. At that point it provides an enable signal 136 to the strobe circuit which then begins refreshing output capacitor 104 and, alternately, powering up to refresh output capacitor 104 and powering down to conserve power. Strobe signals repeat periodically as shown at 138 in dependence upon how quickly the charge on output capacitor 104 depletes as indicated by the saw tooth shape 140 of the compensation voltage 130. It is during each of these strobe periods 138 that the nulling control circuit provides the auto-nulling operation using switching circuits 58, 58*b*. Note that if the strobing is used in conjunction with the auto nulling the refresh period should be over several cycles of the auto nulling period to get the benefits from auto nulling.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An auto-nulled bandgap reference system comprising:

a substrate bandgap core having a differential output;

a primary amplifier for receiving at its input said differential output and a feedback circuit responsive to said primary amplifier to drive to zero said differential output at its input; said primary amplifier having inherent offset and noise errors;

a first storage device connected to a nulling input of said primary amplifier;

an auxiliary amplifier having inherent offset and noise errors;

a second storage device connected to a nulling input of said auxiliary amplifier; and a switching circuit for selectively, in a first mode, shorting the inputs of said auxiliary amplifier and connecting its output to said second storage device to develop a compensation voltage for nulling the noise and offset error of said auxiliary amplifier and in a second mode connecting the input of said nulled auxiliary amplifier in parallel with the input to said primary amplifier and connecting the output of said nulled auxiliary amplifier to said first storage device to develop a compensation voltage for nulling the noise and offset error of said primary amplifier.

2. The auto-nulled bandgap reference system of claim 1 in which said nulling inputs are differential inputs.

3. The auto-nulled bandgap reference system of claim 1 further including a nulling control circuit for providing a switching signal to drive said switching circuit between the first and second modes.

4. The auto-nulled bandgap reference system of claim 3 in which said switching signal is a constant frequency.

5. The auto-nulled bandgap reference system of claim 3 in which said switching signal is hopping frequency.

6. The auto-nulled bandgap reference system of claim 3 in which said switching signal is spread spectrum.

7. The auto-nulled bandgap reference system of claim 1 in which said substrate bandgap core includes a pair of pn junctions.

8. The auto-nulled bandgap reference system of claim 1 in which said substrate bandgap core includes multiple pairs of stacked pn junctions.

9. The auto-nulled bandgap reference system of claim 7 or 8 in which said pn junctions are implemented with diode connected bipolar junction transistors.

10. The auto-nulled bandgap reference system of claim 1 further including a strobe circuit including an output storage device interconnected with the said output of said primary amplifier, and a strobe control circuit for periodically powering up said auto-nulled bandgap reference system to charge said output storage device and powering down said auto-nulled bandgap reference system to conserve power.

11. The auto-nulled bandgap reference system of claim 10 in which said output storage device is interconnected through a switch to said output of said primary amplifier.

12. The auto-nulled bandgap reference system of claim 10 further including a start up circuit responsive to a predetermined condition at said output storage device for enabling said strobe control circuit.

13. The auto-nulled bandgap reference system of claim 12 in which said predetermined condition is a voltage level.

14. The auto-nulled bandgap reference system of claim 12 in which said start up circuit includes a comparator circuit.

15. The auto-nulled bandgap reference system of claim 10 further including a temperature sensor circuit for varying the rate of periodicity of said strobe control circuit as a function of temperature.

16. The auto-nulled bandgap reference system of claim 1 in which said amplifiers are constructed of MOS devices.

17. The auto-nulled bandgap reference system of claim 10 in which said output storage device includes a capacitor.

18. An auto-nulled bandgap reference system comprising:

a substrate bandgap reference circuit including a primary amplifier having inherent offset and noise error;

an auxiliary amplifier circuit having inherent offset and noise error; and a switching circuit for, in a first mode, developing a voltage to null the offset and noise errors of said auxiliary amplifier and in a second mode connecting together in parallel the inputs of said primary and auxiliary amplifiers for developing with said nulled auxiliary amplifier a voltage to null the offset and noise errors of said primary amplifier.

19. The auto-nulled bandgap reference system of claim 18 in which said substrate bandgap reference circuit includes a substrate bandgap core having a differential output; said primary amplifier receives at its output said differential output and a feedback circuit responsive to said primary amplifier output to drive to zero said differential output at its input.

20. The auto-nulled bandgap reference system of claim 19 further including a first storage device connected to a nulling input of said primary amplifier, and a second storage device connected to a nulling input of said auxiliary amplifier.

21. The auto-nulled bandgap reference system of claim 20 in which said switching circuit in a first mode shorts the input of said auxiliary amplifier and connects its output to said storage device to develop a compensation voltage for nulling the noise and offset error of said auxiliary amplifier and in a second mode connecting the input of said nulled auxiliary amplifier in parallel with the input of said primary amplifier and connecting the output of said nulled auxiliary amplifier to said first storage device to develop a compensation voltage for nulling to noise and offset error of said primary amplifier.

22. The auto-nulled bandgap reference system of claim 21 in which said nulling inputs are differential inputs.

23. The auto-nulled bandgap reference system of claim 21 further including a nulling control circuit for providing a switching signal to drive said switching circuit between the first and second modes.

24. The auto-nulled bandgap reference system of claim 23 in which said switching signal is a constant frequency.

25. The auto-nulled bandgap reference system of claim 23 in which said switching signal is hopping frequency.

26. The auto-nulled bandgap reference system of claim 23 in which said switching signal is spread spectrum.

27. The auto-nulled bandgap reference system of claim 21 in which said substrate bandgap core includes a pair of pn junctions.

28. The auto-nulled bandgap reference system of claim 21 in which said substrate bandgap core includes multiple pairs of stacked pn junctions.

29. The auto-nulled bandgap reference system of claim 27 or 28 in which said pn junctions are implemented with diode connected bipolar junction transistors.

30. The auto-nulled bandgap reference system of claim 21 further including a strobe circuit including an output storage device interconnected with the said output of said primary amplifier, and a strobe control circuit for periodically powering up said auto-nulled bandgap reference system to charge said output storage device and powering down said auto-nulled bandgap reference system to conserve power.

31. The auto-nulled bandgap reference system of claim 30 in which including said output storage device is interconnected through a switch to said output of said primary amplifier.

32. The auto-nulled bandgap reference system of claim 30 further including a start up circuit responsive to a predetermined condition at said output storage device for enabling said strobe control circuit.

33. The auto-nulled bandgap reference system of claim 32 in which said predetermined condition is a voltage level.

34. The auto-nulled bandgap reference system of claim 32 in which said start up circuit includes a comparator circuit.

35. The auto-nulled bandgap reference system of claim 30 further including a temperature sensor circuit for varying the rate of periodicity of said strobe control circuit as a function of temperature.

36. The auto-nulled bandgap reference system of claim 18 in which said amplifiers are constructed from MOS devices.

* * * * *